US009784011B2

(12) United States Patent
Walker

(10) Patent No.: US 9,784,011 B2
(45) Date of Patent: Oct. 10, 2017

(54) RAILING SYSTEM AND PICKET FOR A RAILING SYSTEM

(71) Applicant: Peak Innovations Inc., Richmond (CA)

(72) Inventor: Simon Walker, Delta (CA)

(73) Assignee: Peak Innovations Inc., Richmond (CA)

( * ) Notice: Subject to any disclaimer, the term of this patent is extended or adjusted under 35 U.S.C. 154(b) by 295 days.

(21) Appl. No.: 14/273,382

(22) Filed: May 8, 2014

(65) Prior Publication Data

US 2014/0332743 A1 Nov. 13, 2014

Related U.S. Application Data

(60) Provisional application No. 61/821,338, filed on May 9, 2013.

(51) Int. Cl.

| | |
|---|---|
| ***E04H 17/14*** | (2006.01) |
| *E04H 4/06* | (2006.01) |
| *E04F 11/18* | (2006.01) |

(52) U.S. Cl.

CPC ..... *E04H 17/1439* (2013.01); *E04F 11/1817* (2013.01); *E04F 11/1842* (2013.01); *E04F 11/1848* (2013.01); *E04H 17/1443* (2013.01); *E04F 2011/1827* (2013.01); *E04H 4/06* (2013.01); *E04H 2017/1473* (2013.01)

(58) Field of Classification Search

CPC ... E04F 11/18; E04F 11/1817; E04F 11/1836; E04F 11/1842; E04F 11/1848; E04F 2001/1827; E04H 4/06; E04H 17/1421; E04H 17/1439; E04H 17/1443; E04H 17/1473; E04H 17/1478

USPC ... 256/64, 65.02, 65.03, 65.04, 65.06, 65.08

See application file for complete search history.

(56) References Cited

U.S. PATENT DOCUMENTS

| | | | | | |
|---|---|---|---|---|---|
| 399,021 | A * | 3/1889 | Dailey | E04H 17/10 | 256/65.02 |
| 2,771,276 | A * | 11/1956 | Constance, Jr. | E04F 11/181 | 256/22 |
| 3,955,799 | A * | 5/1976 | Lauzier | E04F 11/181 | 256/21 |
| 3,973,756 | A * | 8/1976 | Lauzier | E04F 11/181 | 256/21 |
| 4,014,520 | A * | 3/1977 | Walters | E04F 11/181 | 256/22 |
| 4,027,855 | A * | 6/1977 | Lauzier | E04F 11/181 | 256/21 |
| 4,175,883 | A * | 11/1979 | Lemelson | E04H 17/20 | 256/65.11 |
| 4,346,872 | A * | 8/1982 | Tornya | E04F 11/181 | 256/65.02 |
| 4,586,697 | A * | 5/1986 | Tornya | E04F 11/181 | 256/22 |
| 4,968,005 | A * | 11/1990 | Zen | E04F 11/1836 | 256/22 |

(Continued)

*Primary Examiner* — Josh Skroupa

(74) *Attorney, Agent, or Firm* — Smiths IP; Lawrence Chan

(57) ABSTRACT

A picket for a railing system comprises an elongated body with one or more walls and first and second ends. The first and second ends engage the top and bottom rails, respectively, of the railing system. The picket also comprises one or more cutouts formed along one or more of the walls. Each of the cutouts engages one of the plurality of spacers. The cutouts are proximal to the first and second ends of the pickets.

15 Claims, 7 Drawing Sheets

(56) References Cited

U.S. PATENT DOCUMENTS

| | | | | |
|---|---|---|---|---|
| 7,322,564 | B2 * | 1/2008 | Fakhari | E04H 17/1439 256/59 |
| 2008/0179579 | A1 * | 7/2008 | McGinness | E04H 12/2253 256/64 |

* cited by examiner

RAILING SYSTEM AND PICKET FOR A RAILING SYSTEM

CROSS-REFERENCE TO RELATED APPLICATIONS

This application claims the benefit of U.S. Provisional Application No. 61/821,338 filed May 9, 2013.

FIELD OF THE INVENTION

The invention relates to the field of railings, and in particular, to a picket for a railing system.

BACKGROUND OF THE INVENTION

Railing systems for any number of outdoor applications are well-known. For example, residential decks, pool decks, playgrounds, etc., all utilize any number of conventional railing systems. Such railing systems are typically made of pressure-treated lumber or aluminum that is particularly suited for outdoor use.

Typically, railing systems utilize pickets that engage a top and bottom rail. To save material, pickets are generally tubular in shape, with a bore extending from one end of the picket to the other.

Building codes have been implemented in various jurisdictions throughout the world. Typically, in order to safeguard the public, these codes set minimum performance requirements. One such requirement relates to railing in-fills (i.e. pickets). Pickets are required to meet certain horizontal load requirements.

In the past, when such load requirements were applied to traditional pickets, the pickets have been known to fail, either by deflecting more than what was allowable under code or by simply disengaging from the top or bottom rails. Consequently, such pickets are undesirable, particularly in the residential railing industry where homeowners frequently install or build their own railing systems.

Accordingly, a need exists for an improved picket for a railing system that overcomes the deficiencies noted above.

SUMMARY OF THE INVENTION

According to the invention, a picket for a railing system having at top rail, a bottom rail, and a plurality of spacers comprises an elongated body having one or more walls. The picket further comprises first and second ends for engaging the top and bottom rails, respectively. One or more cutouts are formed along one or more of the walls, and each of the cutouts engage one of the plurality of spacers. The cutouts are proximal to the first and second ends.

In another aspect of the invention, the walls each comprise an outer wall surface and an inner wall surface, with the cutouts formed along the outer wall surface.

In a further aspect of the invention, the cutouts extend through from the outer wall surface to the inner wall surface.

In another aspect of the invention, the one or more walls comprise at least two side walls.

In a further aspect, the cutouts are formed along two of the walls and these two walls are arranged opposed to one another.

In yet a further aspect, the cutouts extend for an entire width of the walls.

In another aspect, the cutouts extend in a substantially horizontal direction.

In a further aspect, a locking picket system according to the invention comprises a top rail, a bottom rail, one or more pickets, and a plurality of spacers. The pickets extend between the top rail and the bottom rail. At least one of the pickets comprises one or more walls, first and second ends for engaging the top and bottom rails, respectively, and one or more cutouts formed along one or more of the side walls. The cutouts are proximal to the first and second ends. At least one of the spacers comprises one or more spacer ends, with the spacers engaging one of the top rail or the bottom rail, and the spacer end engaging one of the cutouts.

In another aspect, the walls each comprise an outer wall surface and an inner wall surface, and the cutouts are formed along the outer wall surface.

In a further aspect, the cutouts extend from the outer wall surface through to the inner wall surface.

In another aspect, the one or more walls comprise at least two walls.

In yet another aspect, the cutouts are formed along two of the walls, and the two walls are arranged opposed to one another.

In a further aspect, the cutouts extend for an entire width of the side walls.

In yet a further aspect, the cutouts extend in a substantially horizontal direction.

In another aspect, each of the top rail and the bottom rail comprises first and second substantially parallel elongated side walls. The elongated side walls each comprise a groove.

In a further aspect, the spacers further comprise wings. The wings engage the grooves of the top rail or the bottom rail.

The foregoing was intended as a summary only and of only some of the aspects of the invention. It was not intended to define the limits or requirements of the invention. Other aspects of the invention will be appreciated by reference to the detailed description of the preferred embodiments. Moreover, this summary should be read as though the claims were incorporated herein for completeness.

BRIEF DESCRIPTION OF THE DRAWINGS

The preferred embodiment of the invention will be described by reference to the drawings thereof, in which.

DESCRIPTION OF THE PREFERRED EMBODIMENT

Figure 1:
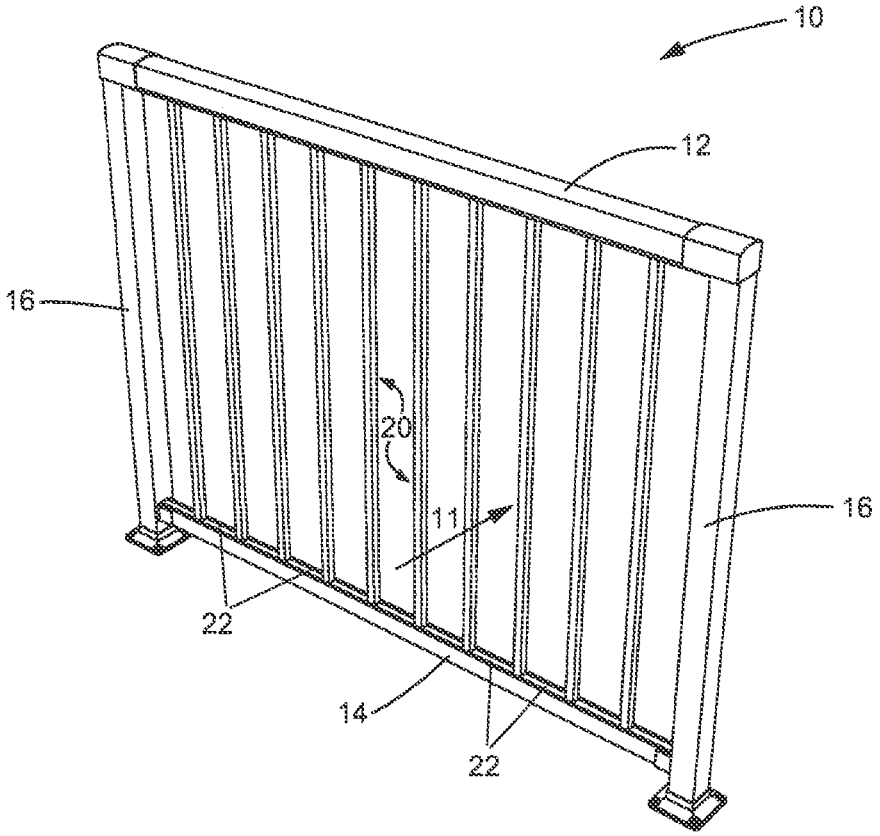
FIG. 1 is a perspective view of a railing system incorporating pickets and spacers in accordance with the present invention.

Referring to FIGS. 1 to 5, a railing system 10 is generally shown comprising a top rail 12, a bottom rail 14, and end posts 16. The railing system 10 also comprises pickets 20, which span between the top rail 12 and the bottom rail 14, and spacers 22, which are located in between the pickets 20. The spacers 22 engage with the top rail 12 and the bottom rail 14.

Figure 6:
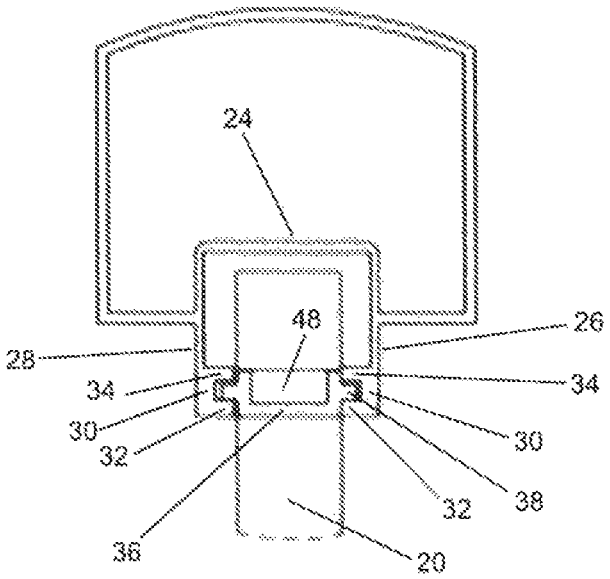
FIG. 6 is an enlarged view of the section of FIG. 5 identified by reference character B.
Figure 7:
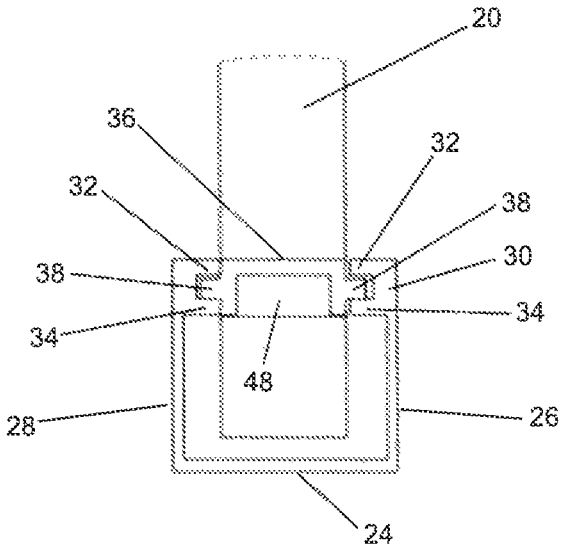
FIG. 7 is an enlarged view of the section of FIG. 5 identified by reference character C.
Figure 8:
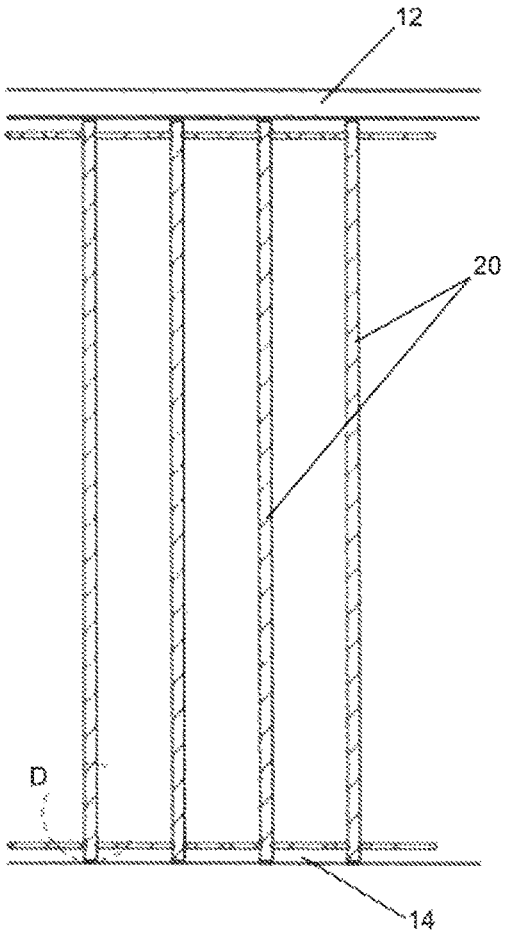
FIG. 8 is a cross-sectional view of FIG. 5 along line 8-8.

FIGS. 6 and 7 are cross-sectional views of the railing system 10, with FIG. 6 depicting the top rail 12 and FIG. 7 depicting the bottom rail 14. Each of the top rail 12 and the bottom rail 14 comprises a substantially elongated planar member 24 and first and second substantially parallel elongated side walls 26, 28 perpendicularly connected to the planar member 24. The side walls 26, 28 each comprise grooves 30 opposite to each other and running substantially parallel to the elongated planar member 24. The top rail 12 preferably comprises a handgrip 25.

The grooves 30 are adapted to engage with the spacers 22 and comprise a first elongated groove member 32 and a second elongated groove member 34. The first elongated groove member 32 is connected proximal to an end of the side walls 26, 28 and extends substantially perpendicularly from the walls 26, 28. The second elongated groove member 34 is also connected adjacent the same end of the side walls 26, 28 and extends substantially parallel to the first elongated groove member 32. The second elongated groove member 34 is preferably spaced away from the first elongated groove member 32 so as to permit snugly insertion of the spacers 22 between the first elongated groove member 32 and the second elongated groove member 34.

The spacers 22 may comprise a planar member 36, spacer ends 37, and parallel wings 38 shaped to be received in the grooves 30. The parallel wings 38 preferably extend away from the planar member 36. As shown in FIGS. 6 and 7, once the spacers 22 are inserted into the top and bottom rails 12, 14, the wings 38 abut the first and second elongated groove members 32, 34. In so doing, the spacers 22 snugly fit into the grooves 30. To provide for an aesthetically pleasing result, the planar member 36 may be spaced apart from the wings 38 so that the planar member 36 lies flush with the first elongated groove member 32 (as seen in FIGS. 6 and 7). However, in another embodiment, those skilled in the art will also appreciate that the wings 38 may be flush with the planar member 36.

Figure 13:
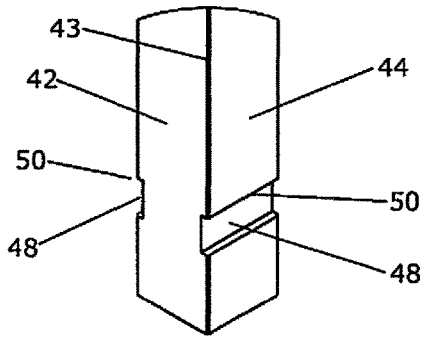
FIG. 13 is an enlarged view of the section of FIG. 12 identified by reference character E.
Figure 14:
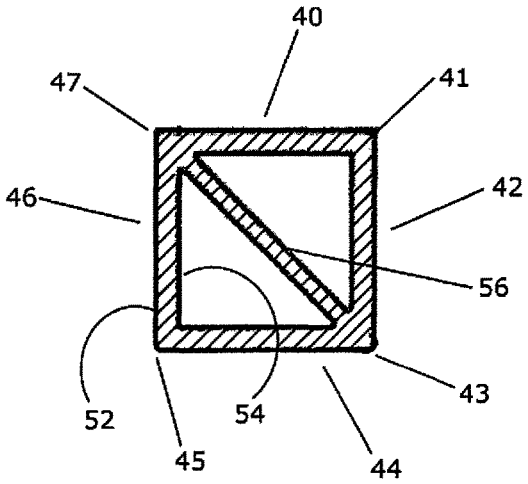
FIG. 14 is a cross-sectional view of FIG. 12 along line 14-14.

Referring to FIGS. 8 to 14, the pickets 20 are generally elongated in shape, with each of the pickets 20 preferably comprising a first wall 40, a second wall 42, a third wall 44, and a fourth wall 46 arranged at substantially right angles to one another to form a substantially rectangular cross-section. The first wall 40 and the second wall 42 form a first corner 41, the second wall 42 and the third wall 44 form a second corner 43, the third wall 44 and the fourth wall 46 form a third corner 45, and the fourth wall 46 and the first wall 40 form a fourth corner 47. Each of the walls 40, 42, 44, and 46 comprises an outer wall surface 52 and an inner wall surface 54. The outer wall surface 52 of the walls 40, 42, 44, 46 generally form part of the overall outer surface of the pickets 20. One or more brace members 56 (as seen in FIG. 14) may extend within the interior of the pickets 20 to increase the rigidity and strength of the pickets 20. In the embodiment shown in FIG. 14, one brace member 56 extends between the second corner 43 and the fourth corner 47. However, those skilled in the art will appreciate that other orientations of the brace member(s) 56 are also possible.

Although the preferred embodiment of the pickets 20 has a substantially rectangular cross-section with four walls 40, 42, 44, 46, in other embodiments, the pickets 20 may have a greater or fewer number of walls, and the cross-sectional shape of the pickets 20 may also be a circle, an oval, or any other particular shape suitable for a picket.

Figure 10:
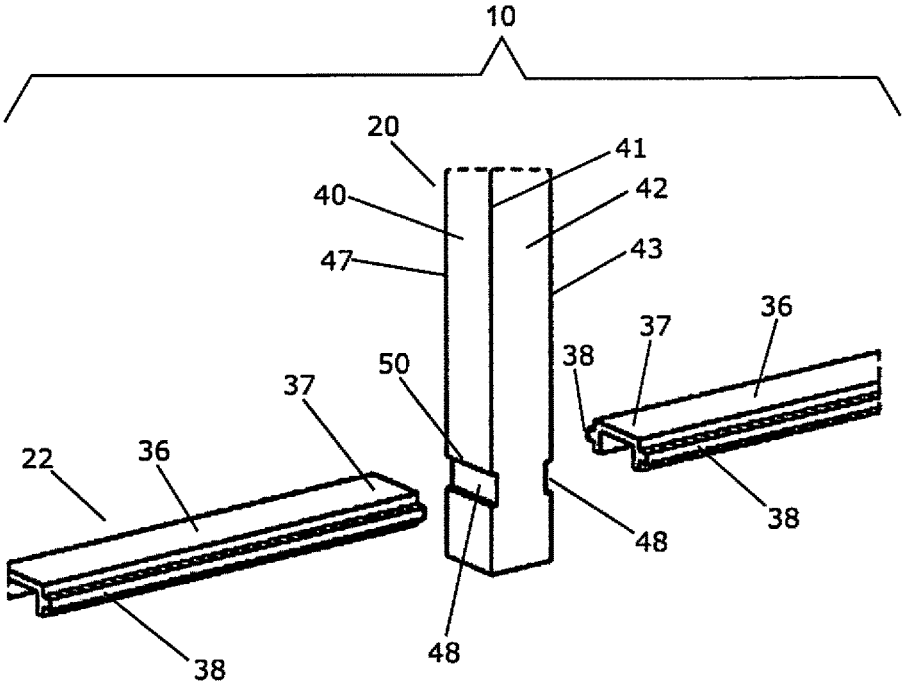
FIG. 10 is an exploded view showing a portion of the lower part of the railing system in accordance with the present invention.
Figure 11:
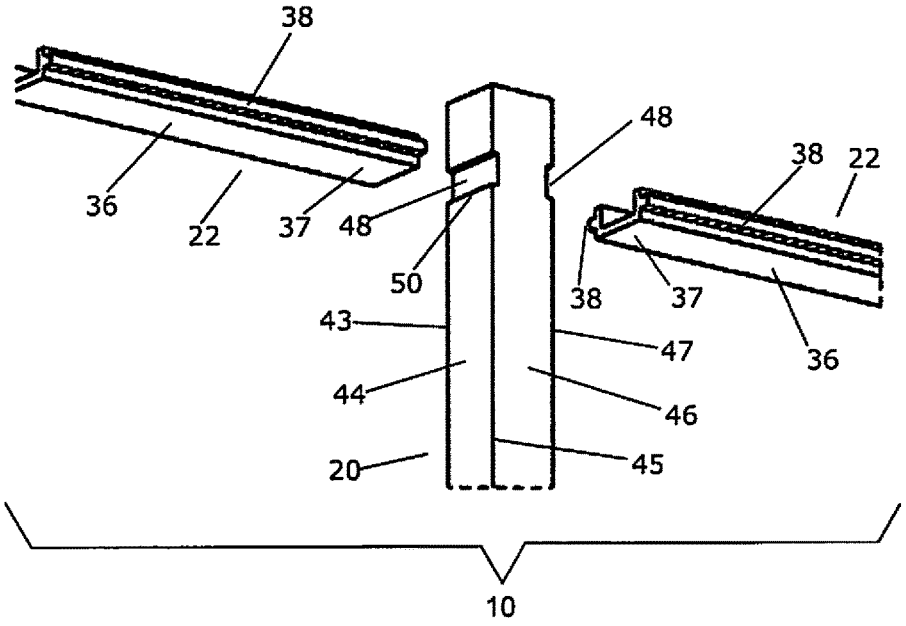
FIG. 11 is an exploded view showing a portion of the upper part of the railing system in accordance with the present invention.
Figure 12:
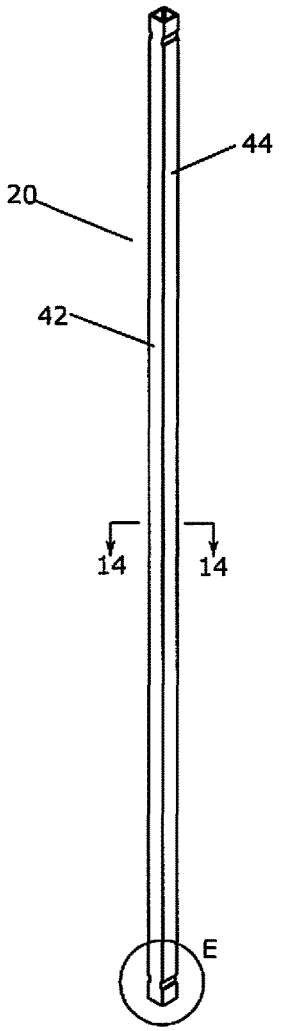
FIG. 12 is a perspective view of a picket in accordance with the present invention.

The pickets 20 further comprise cutouts 48 along one or more sides of the pickets 20 that receive the spacer ends 37. As best shown in FIGS. 10 and 11, the pickets 20 preferably comprise cutouts 48 along opposite walls (e.g. the first wall 40 and the third wall 44) and would be present near both ends of the pickets 20 (i.e. near the top and bottom of the pickets 20). The cutouts 48 are sized such that the spacer ends 37 are able to be fitted within the cutouts 48. The engagement of the spacers 22 and the cutouts 48 helps to lock the pickets 20 in place and helps to prevent the pickets 20 from disengaging from the top and bottom rails 12, 14 when horizontal force 11 is applied to the pickets 20.

Figure 9:
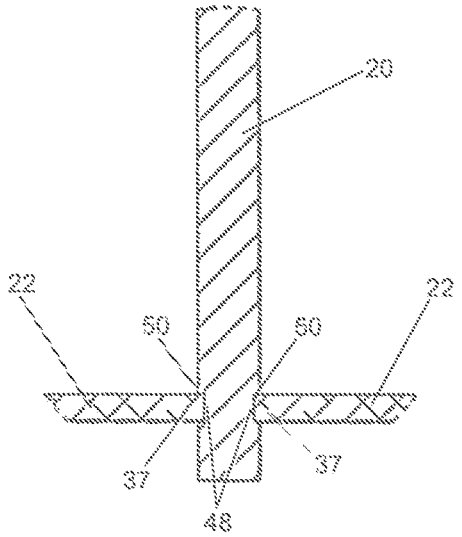
FIG. 9 is an enlarged view of the section of FIG. 8 identified by reference character D.

The cutouts 48 are preferably substantially rectangular in shape, as best shown in FIG. 13, to form slots. The width of the cutouts 48 extends for at least the width of the spacer ends 37, and preferably, the entire width of the walls, as shown in FIG. 13. The height of the cutouts 48 extends at least as high as the spacer ends 37 (as shown in FIG. 9). This allows the spacer ends 37 to be fully engaged within the cutouts 48. Although FIGS. 10 and 11 shows the cutouts 48 being present on both the first wall 40 and the third wall 44, those skilled in the art will appreciate that the cutouts 48 may be present on one wall only (e.g. the first wall 40).

Although FIGS. 10 and 11 shows cutouts 48 extending for the entire widths of the first wall 40 and the third wall 44, it is understood that the cutouts 48 may only extend for a portion or portions of the widths of the first wall 40 and the third wall 44. For example, the first wall 40 may have a series of cutouts 48 spaced apart from one another. In this embodiment, the spacer end 37 that is inserted into the first wall 40 would have suitable tongues that correspond with the locations of the cutouts 48 such that the tongues would engage the cutouts 48 and secure the picket 20 in place. Similarly, if the width of the spacer end 37 was less than the width of the first wall 40, then the width of the cutout 48 would only need to be slightly greater than the width of the end of the spacer 22. In such a case, the cutout 48 may not necessarily extend for the entire width of the first wall 40.

Figure 2:
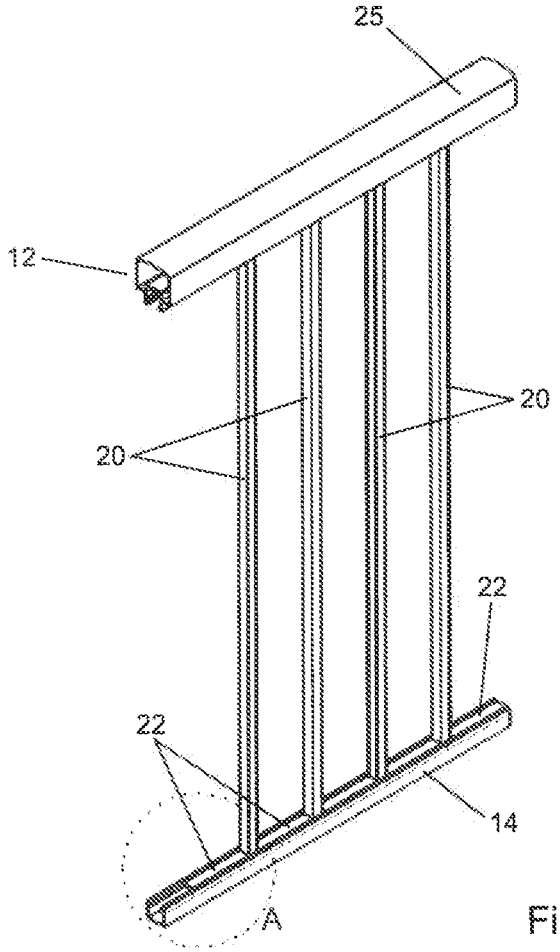
FIG. 2 is a cutaway perspective view of a portion of the railing system of FIG. 1.
Figure 3:
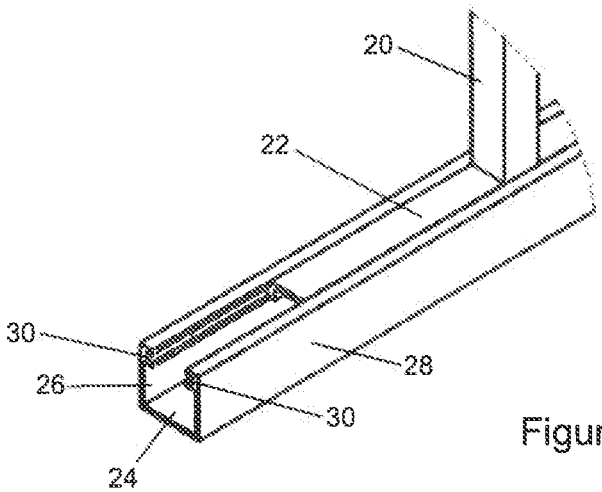
FIG. 3 is an enlarged view of the section of FIG. 2 identified by reference character A.
Figure 4:
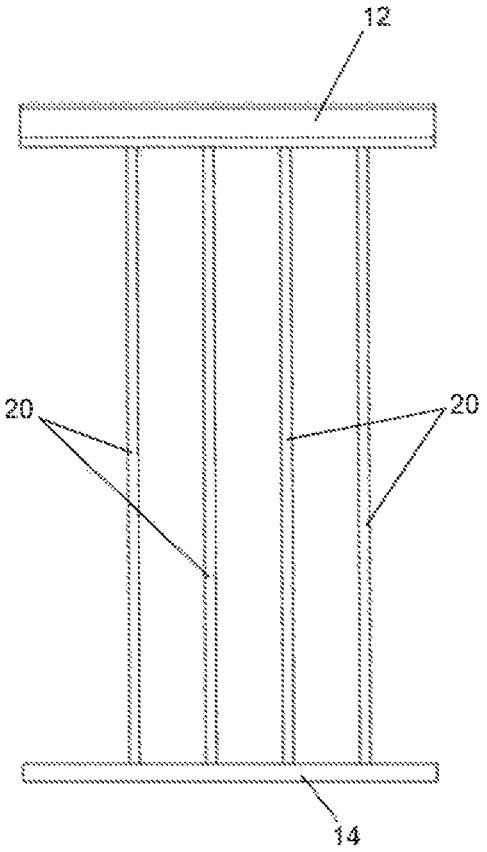
FIG. 4 is a front view of the portion of the railing system shown in FIG. 2.
Figure 5:
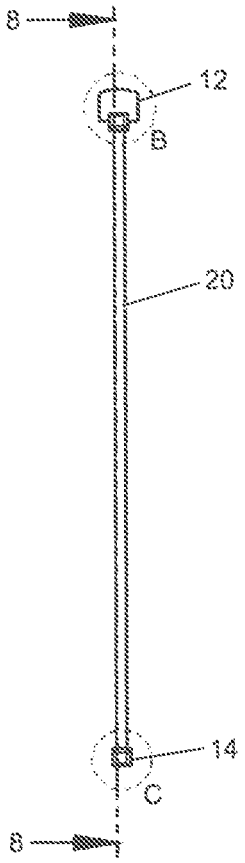
FIG. 5 is a side view of the portion of the railing system shown in FIG. 2.

Referring to FIGS. 2 and 3, once the railing system is assembled, the cutouts 48 are preferably not visible. This may be achieved by selecting a first edge 50 for the cutouts 48 that approximately corresponds to the position of the planar members 36 of the spacers 22 when the spacers 22 are engaged within the cutouts 48. In this manner, when the spacer ends 37 are engaged and locked within the cutouts 48, the planar members 36 of the spacers 22 lies substantially flush with the first edge 50 of the cutouts 48 of the pickets 20, as shown in FIG. 9.

The cutouts 48 may be formed by narrowing the thickness of the walls of the pickets 20 at those particular locations. For example, in the embodiment shown in FIG. 13, the cutouts 48 may be formed by narrowing the thicknesses of the third wall 44 (and the first wall 40) at the specific locations where the cutouts 48 are present. In this embodiment, the cutouts 48 therefore do not extend through the entire depth of the first wall 40 or the third wall 44 but instead, the cutouts 48 are only formed on the outer wall surfaces 52 of the first wall 40 and the third wall 44 (and not on the inner wall surfaces 54 of the first wall 40 and the third wall 44). In this embodiment, the cutouts 48 will appear as grooves or recesses on the walls. It will be appreciated by those skilled in the art that the cutouts 48 may be formed by other methods as well, such as by molding.

In another embodiment, the cutouts 48 may extend for the entire depth of the walls. In this embodiment, the cutouts 48 will appear as openings or slits in the walls. In this embodiment, the cutouts 48 would extend from the outer wall surface 52 through to the inner wall surface 54 of the respective walls.

The assembly of the railing system 10 will now be described. One end of the top rail 12 and one end of the bottom rail 14 are connected to the post 16. At least one spacer 22 is inserted into each of the top rail 12 and the bottom rail 14, with the wings 38 of the spacers fitting within the grooves 30 of the walls 26, 28. One of the pickets 20 is then installed between the top rail 12 and the bottom rail 14 by placing the ends of the picket 20 into the top rail 12 and the bottom rail 14, with the cutouts 48 facing away from the walls 26, 28. One of the cutouts 48 near of the top end of the picket 20 would engage with the spacer end 37 inserted into the top rail 12. Similarly, one of the cutouts 48 near the bottom end of the picket 20 would engage with the spacer end 37 inserted into the bottom rail 14. These cutouts 48 would be on the same wall of the picket 20.

Two further spacers 22 would be inserted, one for the top rail 12 and one for the bottom rail 14. The spacer end 37 inserted for the top rail 12 would engage with the cutout 48 near the top end of the picket 20 (on the opposing wall from the engagement of the first spacers 22). Similarly, the spacer end 37 inserted for the bottom rail 14 would engage with the cutout 48 near the bottom end of the picket 20. Additional pickets 20 and spacers 22 may be inserted in a similar manner, preferably with the placement of the pickets 20 and the spacers 22 alternating. Finally, another post 16 may be connected to the other ends of the top rail 12 and the bottom rail 14 to complete the railing system 10. Alternatively, the top rail 12 and the bottom rail 14 may first be attached to a wall (not shown) without the need for the initial post 16.

Preferably, each picket 20 would engage with four spacers 22, two near the top end of the picket 20 and two near the bottom end of the picket 20. Similarly, each spacer 22 would preferably engage with two pickets 20, one at each spacer end 37. In this manner, the interlocking of the spacers 22 and the pickets 20 provides rigidity to the overall railing system 10 and helps in preventing horizontal displacement of the pickets 20.

It will be appreciated by those skilled in the art that the preferred embodiment has been described in some detail but that certain modifications may be practiced without departing from the principles of the invention.

The invention claimed is:

1. A railing system comprising:

a top rail;

a bottom rail, wherein said top rail and said bottom rail each comprise first and second substantially parallel elongated sidewalls;

one or more pickets extending between said top rail and said bottom rail, at least one of said pickets comprising:

four walls comprising first and second sets of opposed walls, wherein said first set of opposed walls comprises a substantially continuous surface and wherein said second set of opposed walls comprises one or more cutouts formed therealong; and first and second ends for engaging said top and bottom rails, wherein a portion of said first set of opposed walls proximal to said first and second ends are in direct contact with said sidewalls of said top and bottom rails, respectively;

wherein each of said cutouts is proximal to one of said first and second ends and wherein said cutouts generally extend between said sidewalls; and a plurality of spacers, at least one of said spacers comprising:

a substantially planar portion;

wings extending away from said planar portion, wherein said wings extend staggered, and parallel, to said planar portion; and one or more spacer ends, wherein said spacers engage one of said top rail or said bottom rail and wherein said spacer ends engage said cutouts;

wherein said cutouts extend for a height on said second set of opposed walls at least equal to a distance between said planar portion and said wings.

2. The railing system of claim 1, where said walls comprise an outer wall surface and an inner wall surface, and wherein said cutouts are formed along said outer wall surface.

3. The railing system of claim 1, wherein said cutouts extend in a substantially horizontal direction.

4. The railing system of claim 3, wherein said cutouts extend for an entire width of said walls.

5. The railing system of claim 3, wherein said cutouts extend for a portion of a width of said walls.

6. The railing system of claim 1, wherein said four walls form a substantially rectangular cross-section.

7. The railing system of claim 1, wherein said pickets further comprise brace members extending within an interior of said four walls.

8. The railing system of claim 1, wherein each of said sidewalls comprises elongated first and second groove members defining a groove, wherein said first groove members extend from an outer edge of said sidewall.

9. The railing system of claim 8, wherein said wings engage said grooves of said top rail or said bottom rail.

10. A railing system comprising:

a top rail comprising:

a top planar member; and first and second substantially parallel elongated top sidewalls extending perpendicularly from said top planar member;

a bottom rail comprising:

a bottom planar member; and first and second substantially parallel elongated bottom sidewalls extending perpendicularly from said bottom planar member;

one or more pickets extending between said top rail and said bottom rail, at least one of said pickets comprising:

four walls comprising first and second sets of opposed walls, wherein said first set of opposed walls comprises a substantially continuous surface and wherein said second set of opposed walls comprises one or more cutouts formed therealong; and first and second ends for engaging said top and bottom rails, wherein a portion of said first set of opposed walls proximal to said first end is in direct contact with said top sidewalls and another portion of said first set of opposed walls proximal to said second end is in direct contact with said bottom sidewalls;

wherein each of said cutouts is proximal to one of said first and second ends and wherein said cutouts generally extend horizontally between either said top sidewalls or said bottom sidewalls; and a plurality of spacers, said spacers comprising:

a substantially planar portion;

wings extending away from said planar portion, wherein said wings extend staggered, and parallel, to said planar portion; and first and second spacer ends, wherein said spacers engage one of said top rail or said bottom rail and wherein at least one of said first and second spacer ends engage one of said cutouts;

wherein said cutouts extend for a height on said second set of opposed walls at least equal to a distance between said planar portion and said wings.

11. The railing system of claim 10, wherein each of said top sidewalls comprises elongated first and second groove members defining a top groove, wherein said first groove members extend from a lower edge of said top sidewalls.

12. The railing system of claim 11, wherein said first end contacts said top grooves.

13. The railing system of claim 10, wherein each of said bottom sidewalls comprises elongated first and second groove members defining a bottom groove, wherein said first groove members extend from an upper edge of said bottom sidewalls.

14. The railing system of claim 13, wherein said second end contacts said bottom grooves.

15. The railing system of one of claim 11 or 13, wherein said wings engage either said top grooves or said bottom grooves.

* * * * *